US005957703A

United States Patent [19]

Arai et al.

[11] Patent Number: 5,957,703

[45] Date of Patent: Sep. 28, 1999

[54] INTERCONNECTING ELECTRICAL CONNECTOR

[75] Inventors: Tatsuya Arai; Masayuki Nagashima, both of Tokyo, Japan

[73] Assignee: Hirose Electric Co., Ltd., Tokyo, Japan

[21] Appl. No.: 09/022,478

[22] Filed: Feb. 12, 1998

[30] Foreign Application Priority Data

Feb. 12, 1997 [JP] Japan ..... 9-041444

[51] Int. Cl.[6] ..... H01R 9/09

[52] U.S. Cl. ..... 439/66; 439/591

[58] Field of Search ..... 439/66, 71, 91, 439/591

[56] References Cited

U.S. PATENT DOCUMENTS 5,308,252 5/1994 Mroczkowski et al. ..... 439/66

5,498,166 3/1996 Rothenberger .

5,573,435 11/1996 Gabbe et al. ..... 439/91

*Primary Examiner*—Steven L. Stephan

*Assistant Examiner*—J. F. Duverne

*Attorney, Agent, or Firm*—Kanesaka & Takeuchi

[57] ABSTRACT

A contact element 1 comprises a rigid fixing section 2 to be inserted into a slot 12 of an insulation housing 10 and a flexible section 3 extending from the fixing section 2. The flexible section 3 comprises a pair of upper and lower first thin springs 5 extending from the fixing section 2 and a pair of second thin springs 6 extending from the first thin springs 5 and connect with or spaced from each other. A pair of contact points 7 are provided at the joints between the first and second thin springs.

8 Claims, 12 Drawing Sheets

INTERCONNECTING ELECTRICAL CONNECTOR

BACKGROUND OF THE INVENTION

1. Filed of the Invention

The present invention relates to interconnecting electrical connectors placed between two mating connectors for connecting these mating connectors.

2. Description of the Related Art

U.S. Pat. No. 5,498,166 discloses an interconnect system of this type. As FIG. 12 shows, an E-shaped contact element 51 of this interconnect system is held by left and right housings 52 and 53. The contact element 51 has a pair of semi-circular contact sections 51A at free ends and a U-shaped central fitting section 51B. A pair of fixing sections 51C are provided at the bottom of the fitting sections 51B.

The left and right housing 52 and 53 extend in a first direction perpendicular to the sheet, and slots 52A and 53A are provided in the left and right housings 52 and 53, respectively, in a second direction parallel to the sheet for receiving the contact element 51. The slots 52A and 53A are provided at a plurality of positions in the first direction. The slots 52A open at upper and lower sides and a right side of the left housing 52. A central fitting support 52B extends to the right. The slot 53A of the right housing 53 has a size sufficiently large to receive the fixing section 51C of the contact element 51.

To assemble such a connector, first of all, the contact element 51 is incorporated in the left housing 52 such that the contact element 51 are placed in the slots 52A, with the contact sections 51A projected from the slots 52A and the U-shaped fitting section 51B fitted over the central fitting support 52B.

Then, the right housing 53 is joined with the left housing 52 such that the fixing section 51C of the contact element 51 is fitted in the slot 53A of the right housing.

When a pair of mating connection devices, such as mating connectors, circuit boards, or IC packages, are connected to the upper and lower ends of the interconnecting connector, their connection members press the projected contact sections 51A to the inside, making resilient contact. Thus, the interconnecting connector is placed between the mating connectors for connecting them.

Since the fixing section 51C of the above connector is provided in a line including the contact sections 51A, the contact sections 51A moves in a vertical direction. Consequently, there is no horizontal sliding contact between the contact sections 51A and the connection members of the mating connectors, producing no "wiping effects". This allows accumulation of dir and dust on the contact elements, causing poor contact. In addition, if the contact elements are made smaller in order to meet the miniaturization demand, they become more prone to breakage during the use.

Since the contact elements extend in the E-shape, the transmission distance between the contact sections 51A is so large to be poor in transmission characteristics. The transmission line is so thin that the d.c. resistance is high.

Since the housing is split into left and right sides, the component cost and the assembling cost are high.

SUMMARY OF THE INVENTION

Accordingly, it is an object of the invention to provide an interconnecting electrical connector capable of producing the wiping effects, providing not only excellent transmission characteristics but also low d.c. resistance, and reducing the manufacturing costs.

The interconnecting electrical connector comprises an insulation housing having at least one slot extending in a direction of thickness of the insulation housing and at least one contact element made by stamping from a metal sheet and inserted into the slot. The contact element has a pair of contact points projecting from the housing so that when a pair of mating connectors are placed on opposite faces of the housing, the contact elements of the mating connectors make resilient contact with the contact points to connect the mating connectors.

The contact element comprises a rigid fixing section to be inserted into the slot along one side of the slot and a flexible section extending from the fixed section toward the other side of the slot in a plane. The flexible section comprises a pair of upper and lower first thin springs extending from the fixing section toward openings of the slot and a pair of second thin springs extending from the first thin spring and closed or spaced at ends. A pair of contact points are provided at joints between the first and second thin springs.

When a pair of mating connectors are placed on opposite faces of the housing of the interconnecting connector, the upper and lower contact points are brought into resilient contact with the contact portions of the mating connectors so that the mating connectors are connected by the interconnecting connector.

The contact points of the contact element according to the invention move both vertically and horizontally under the pressure. This horizontal movement with respect to the contact portions of the mating connectors produces the wiping effects.

The transmission line between the upper and lower contact points is made up of the first and second thin springs. Consequently, the transmission line is shorter than the conventional one and has a resistance lower than the convention one.

When the contact element is released from the mating connectors, the second thin springs provide the first thin springs with more recovery force, thus reinforcing them in the miniaturized model.

By providing the fixing section with an engaging portion and the slot with a stepped portion for engagement with the engaging portion, it is possible to determined the insertion depth and horizontal position of the fixing section in the slot.

The linking section for linking the flexible section to the fixed section is bent in a crank-like fashion such that the flexible and fixing sections are in two parallel planes, and a pair of slots are arranged so as to make a point symmetry and flexible section receiving sections facing each other, so that the contact points of the two contact elements move in opposite directions, balancing the forces to move the mating connectors.

The flexible section is linked to the fixing section at an angle, and the fixing sections are arranged in a line, so that a plurality of contact elements are inserted into the slots in a lump. That is, a plurality of fixing sections are linked to a carrier, and the carrier is held by an automatic machine to make a lump insertion and then the contact elements are severed from the carrier.

DESCRIPTION OF THE PREFERRED EMBODIMENT

Embodiments of the invention will now be described with reference to the accompanying drawings.

Figure 1:
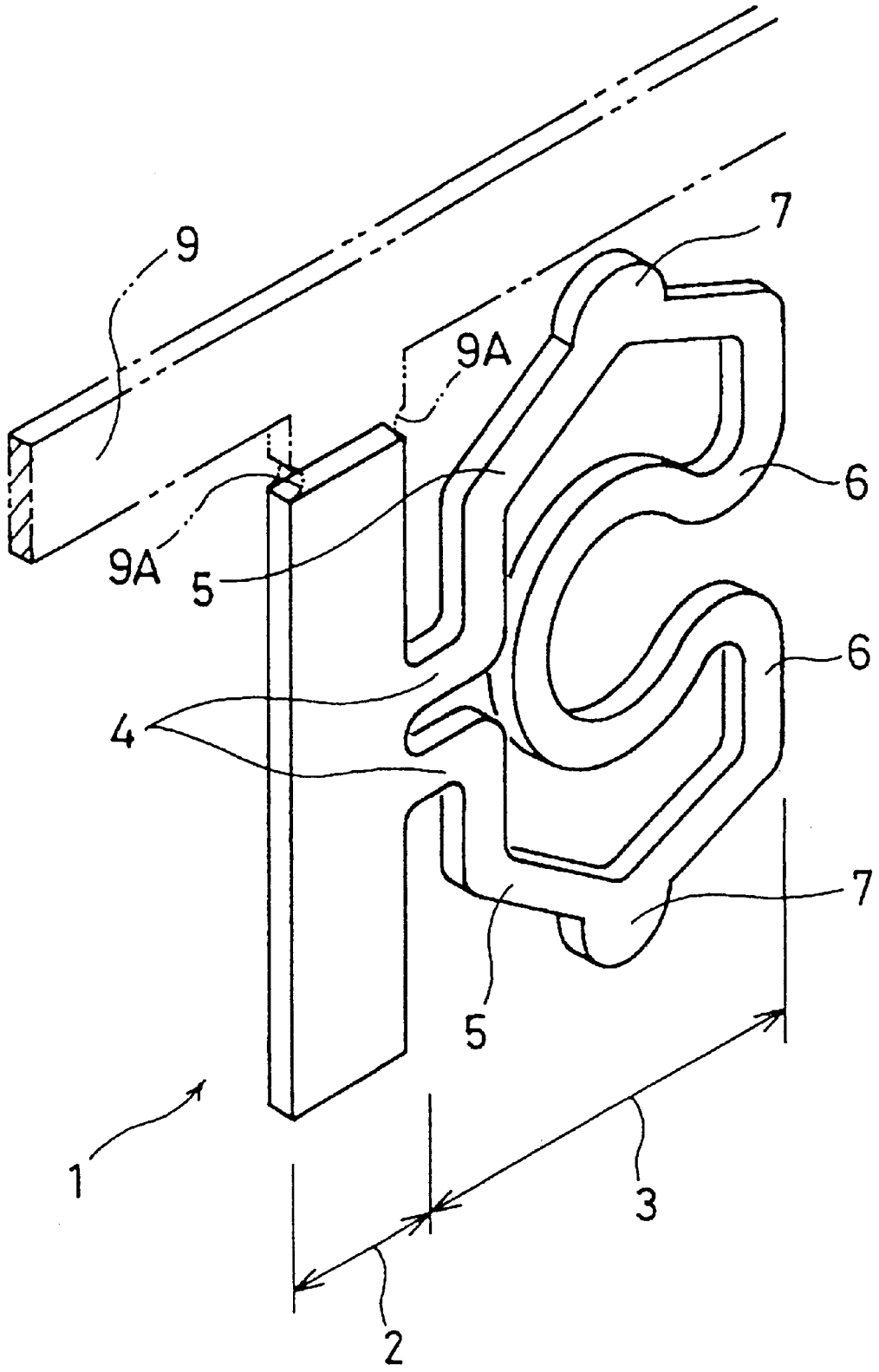
FIG. 1 is a perspective view of a contact element for an interconnecting electrical connector according to an embodiment of the invention.

FIG. 1 shows a contact element for an interconnecting electrical connector according to an embodiment of the invention. The contact element 1 is made by stamping from a metal sheet. It is not bent in a direction of the thickness of the metal sheet and lies in a plane. It has a fixing section 2 and a flexible section 3 which extends laterally from the fixing section 2.

The fixing section 2 is rigid and has a width sufficiently large to withstand the force applied upon insertion into a slot of an insulating housing. The height of the fixing section 2 is set within the depth of the slot. The flexible section 3 is connected to the fixing section 2 via a pair of linking sections 4. A pair of first thin springs 5 extend diagonally outwardly from the linking sections 4, and a pair of second thin spring 6 extend diagonally inwardly from the first thin springs 5. In this embodiment, the second thin springs 6 get closer at the right end and curved on the left side and connected near the linking sections 4, forming a loop.

A semi-circular contact points 7 are provided at joints between the first and second thin springs 5 and 6. The size and position of the contact points 7 are set such that when the contact element 1 is placed in a slot of an insulation housing, the contact points 7 project from the slot. The shape of the contact sections 7 is not critical but is preferred to be such that the contact sections 7 are able to slidably contact the connection members of mating connectors.

Figure 2:
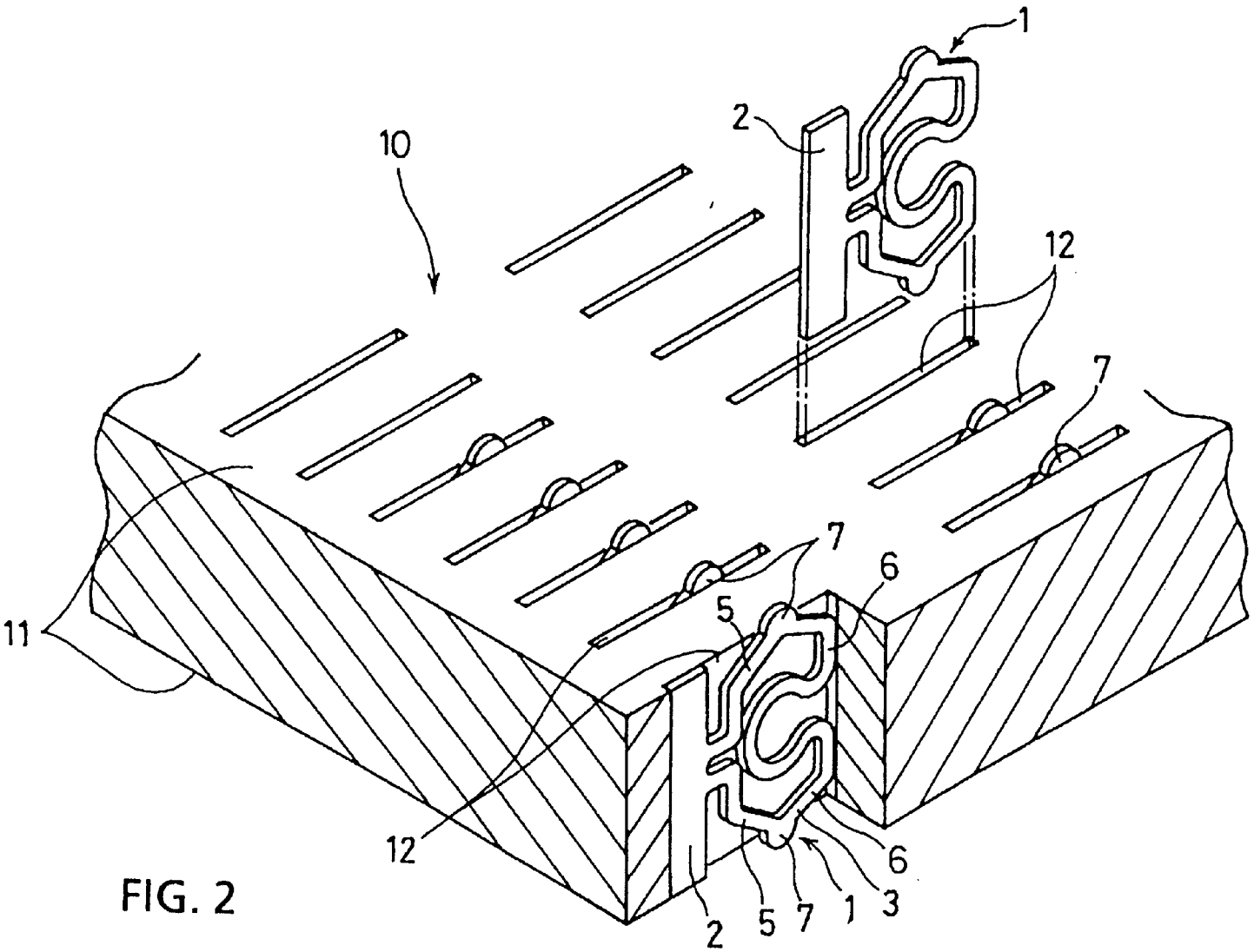
FIG. 2 is a partially cutaway, perspective view of an essential part of the interconnecting electrical connector in which contact elements are incorporated.

As FIG. 2 shows, the insulation housing 10 has upper and lower faces 11 and a plurality of slots 12 extending between the upper and lower faces. In this embodiment, the insulation housing 10 has a flat plate-like form, and mating connectors (not shown) are placed on the upper and lower faces 11.

The slot 12 is made sufficiently large to receive the contact element 1 from above. The contact element 1 is inserted into the slot 12 by holding the fixing section 2 with an insertion tool or the like. When the contact element 1 is inserted into the slot 12, the contact points 7 project from the upper and lower faces 11 of the housing 10.

The mating connectors are placed on the upper and lower faces 11 of the insulating housing in which the contact elements 1 are inserted such that the connection members of the mating connectors are brought into spring contact with the contact points 7 of the contact elements 1, thus connecting the mating connectors via the interconnecting connector.

The contact points 7 are pressed by the mating connectors, and the first thin springs 5 are flexed at the linking sections 4 as a fulcrum against the second thin springs 6 so that the contact points 7 are moved both vertically (up/down direction) and horizontally (laterally). Consequently, the contact points 7 make sliding contact with the connection members of the mating connectors, thus producing the wiping effects.

Most electric current flows from the first thin spring 5 of one end (or upper contact point 7) to the first thin spring 5 of the other end (or lower contact point 7) via the linking section 4 because the line of the first thin springs 5 is shorter than the line of the second thin springs 6. The transmission line via the first thin springs 5 is considerably shorter than the conventional one.

When the mating connectors are removed, the contact points 7 quickly return to the original positions under the spring force of the first and second thin springs 5 and 6. In this way, the second thin springs 6 reinforce the first thin springs 5 so that the miniaturized contact elements 1 are strong and suitable for the miniaturized connectors.

A plurality of the contact elements 1 are linked to a carrier 9 as shown in FIG. 1 so that an automatic machine simultaneously insert them into a plurality of slots. Upon insertion, the contact elements are severed from the carrier 9 at notches 9A.

Figure 3:
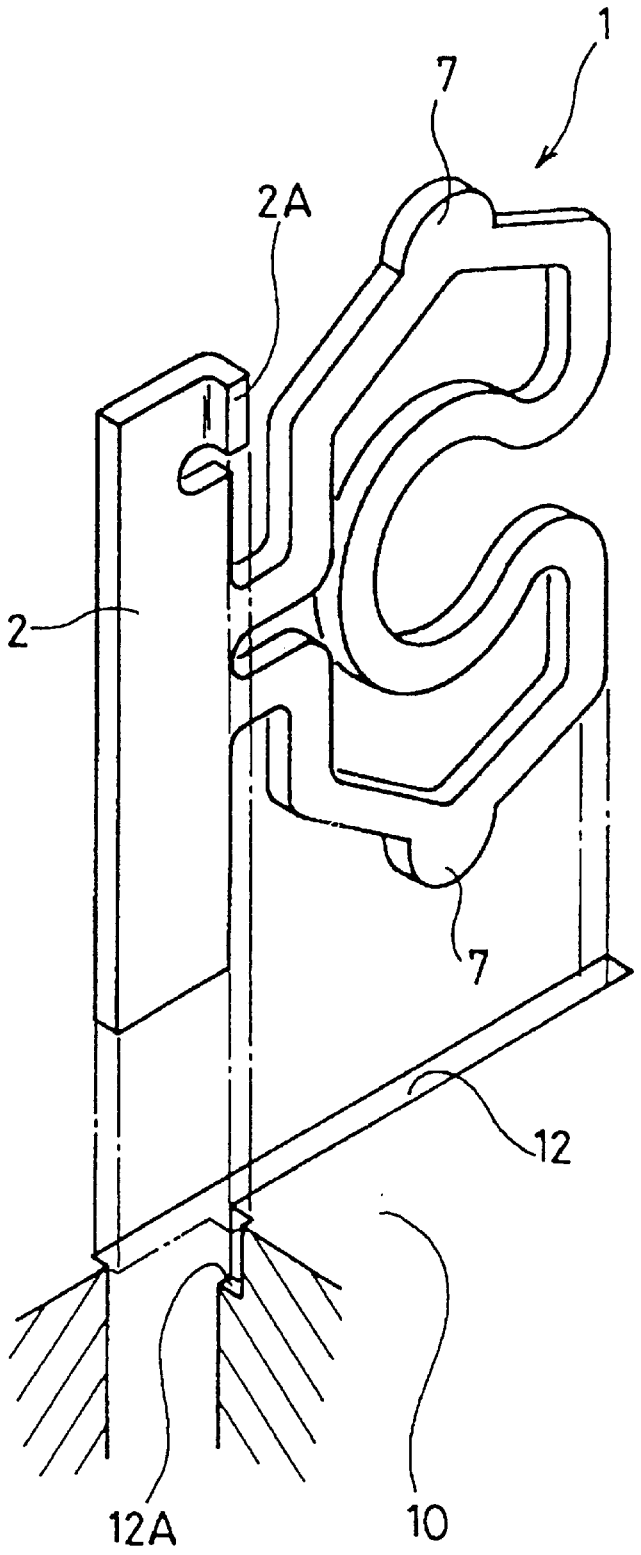
FIG. 3 is a perspective view of a modified contact element.

There are several variations or modifications of the contact elements 1. For example, as FIG. 3 shows, an L-shaped hook or engaging portion 2A is provided on the fixing section 2 while an engaging recess or stepped portion 12A is provided in the slot 12 of the insulation housing 10 so that the contact elements 1 are aligned at the insertion positions for automatic insertion into the slots 12.

Figure 4:
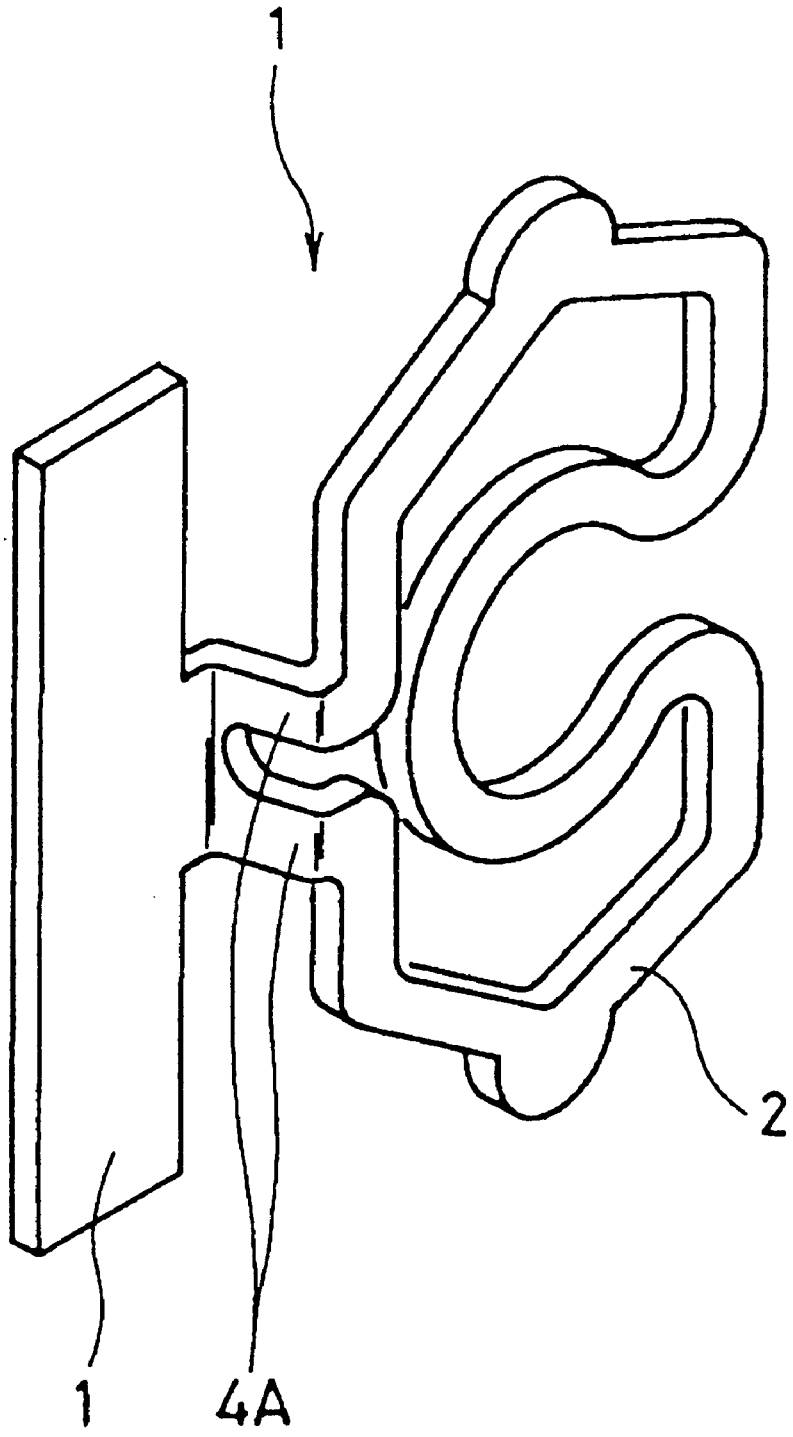
FIG. 4 is a perspective view of another variation of the contact element of FIG. 1.
Figure 5:
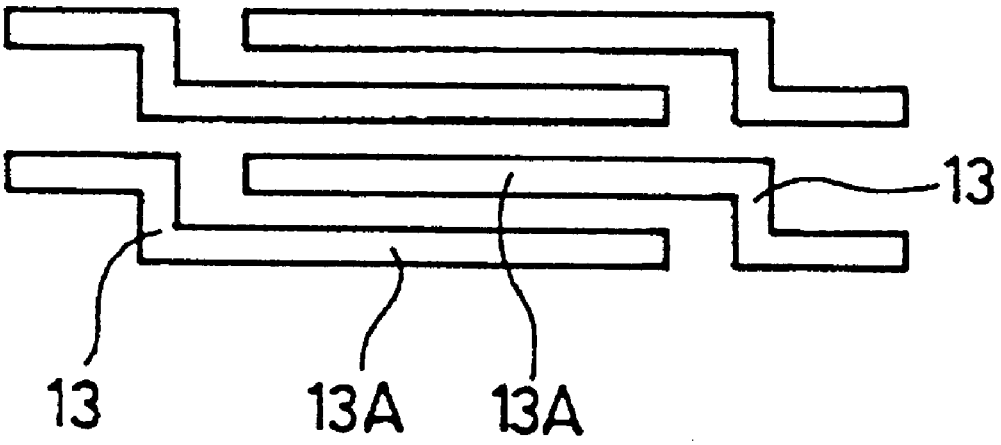
FIG. 5 is a plan view of a housing having slots therein.

According to another embodiment of the invention, as FIG. 4 shows, the flexible section 3 is linked to the fixing section 2 in a crank-like form via the linking section 4A. As FIG. 5 shows, a pair of crank-like slots 13 are provided so as to make a point symmetry so that the flexible section receiving sections 13A face each other. This allows insertion of a pair of identical contact elements 1 into a pair of the slots 13. In addition, movements of the contact points 7 become opposite in the pair so that the sliding contacts are balanced and the wiping effects are provided without making poor contact resulting from unbalanced sliding forces of the contact elements.

Figure 6:
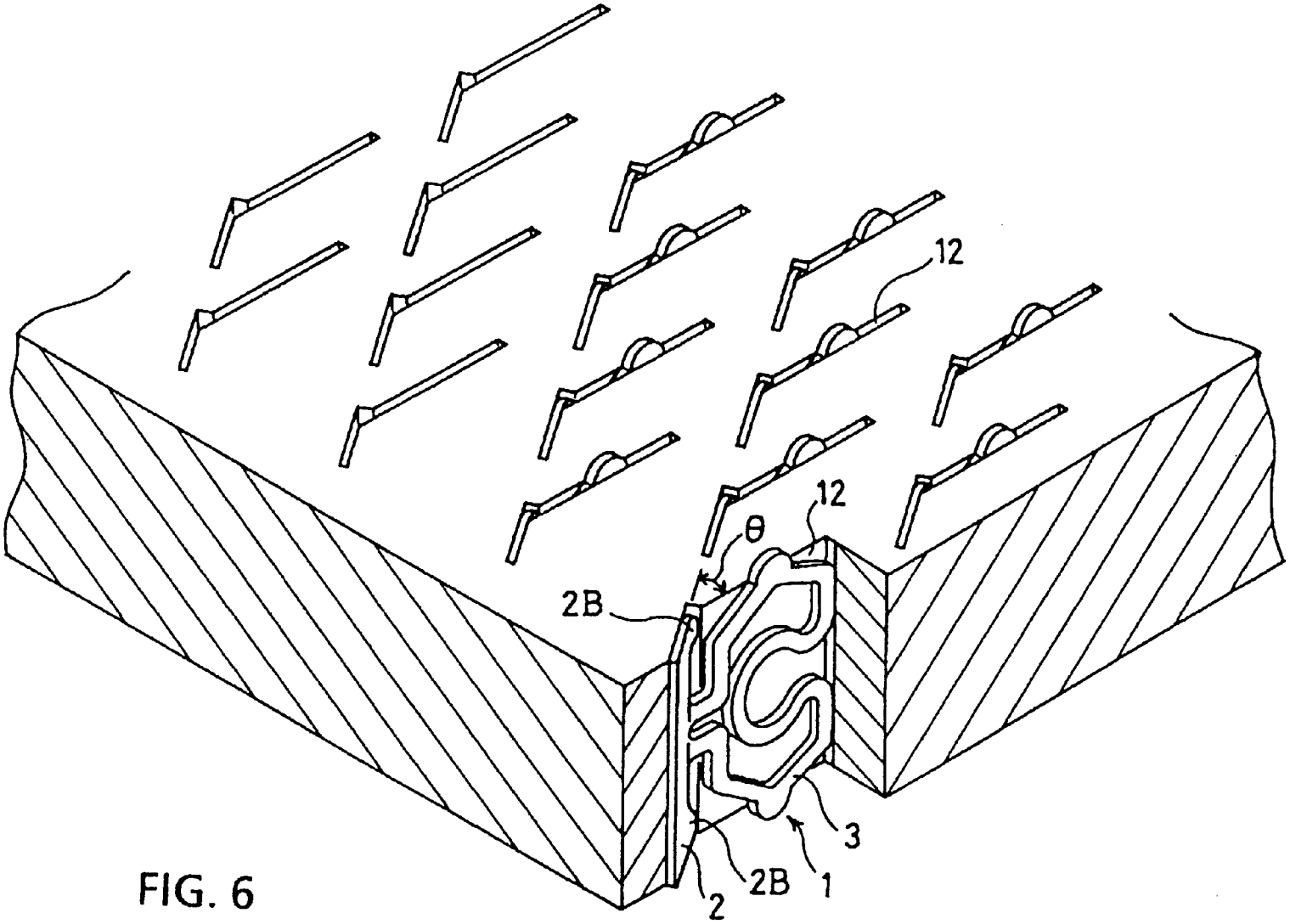
FIG. 6 is a partially cutaway, perspective view of an essential part of the connector.

According to still another embodiment of the invention, as FIG. 6 shows, the flexible sections 3 are linked to the fixing sections 2 with an angle θ. The slots 12 are also made with such an angle θ. A pair of abutting projections 2B are provided at opposite ends of the fixing section 2 to abut against the walls of the slot 12, producing a reactive gripping force. Engaging indentations provided in the walls facilitates automatic insertion by positioning. Since a plurality of the fixing sections can be provided in a plane (FIG. 6), the contact elements can be inserted into the slots simultaneously by an automatic machine with the use of a carrier such as shown in FIG. 1.

The flexible section having the first and second thin springs may also be modified.

Figure 7:
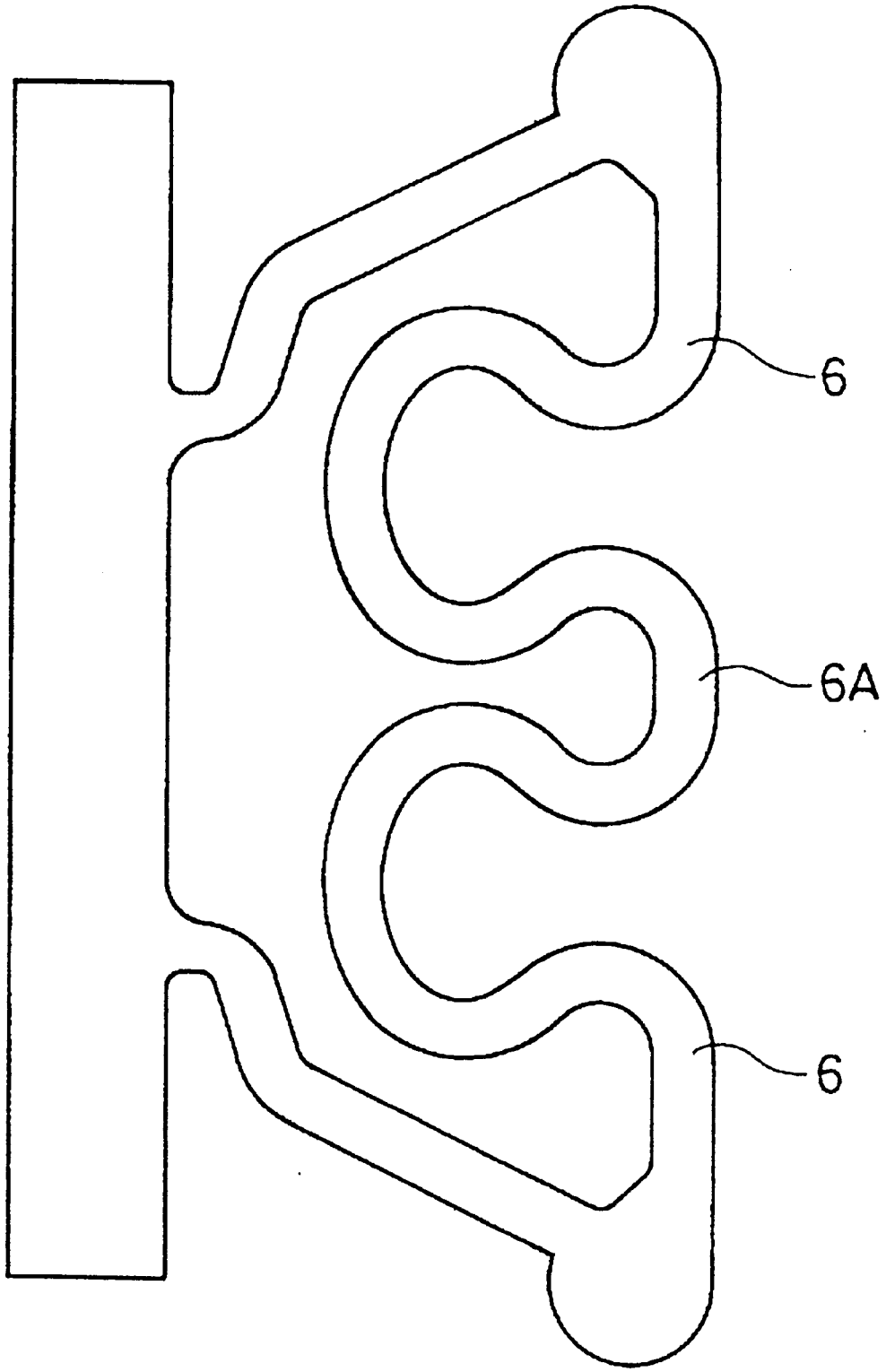
FIG. 7 is a front view of a still another contact element.

For example, as FIG. 7 shows, an additional curved section 6A is provided between the second thin springs 6 to enhance the flexibility.

Figure 8:
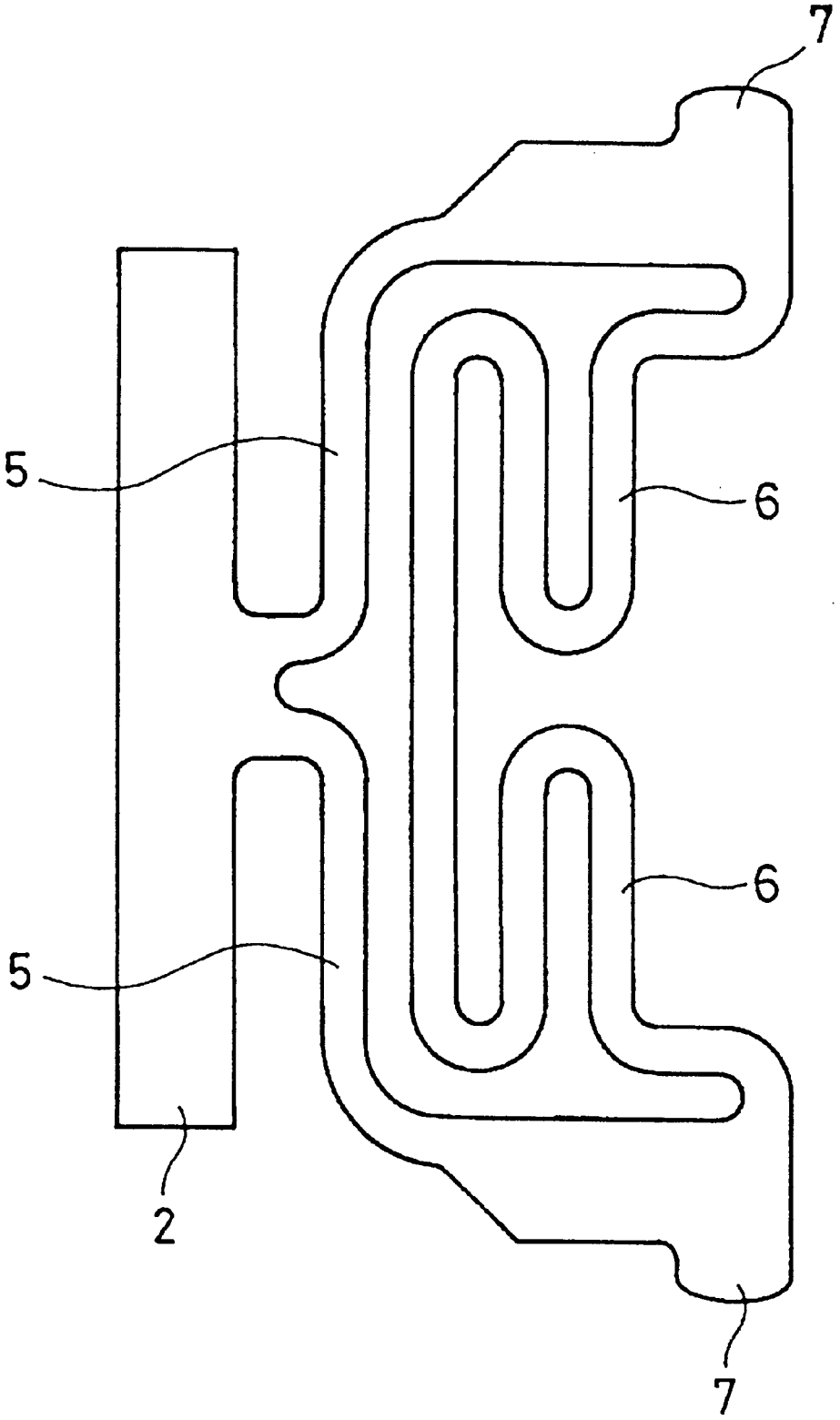
FIG. 8 is a front view of a yet another contact element.

In FIG. 8, both the first and second thin springs 5 and 6 are elongated to improve the flexibility.

Figure 9A:
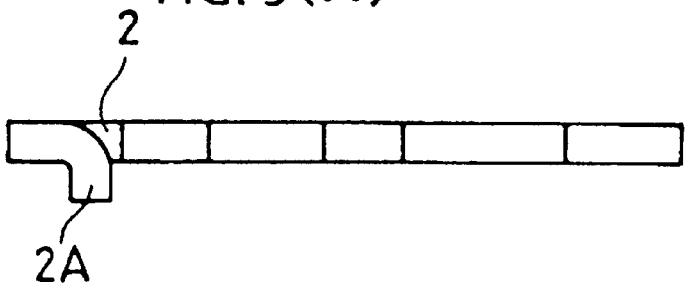
FIGS. 9A and 9B are top and front views of a variation of the contact element of FIG. 8.
Figure 9B:
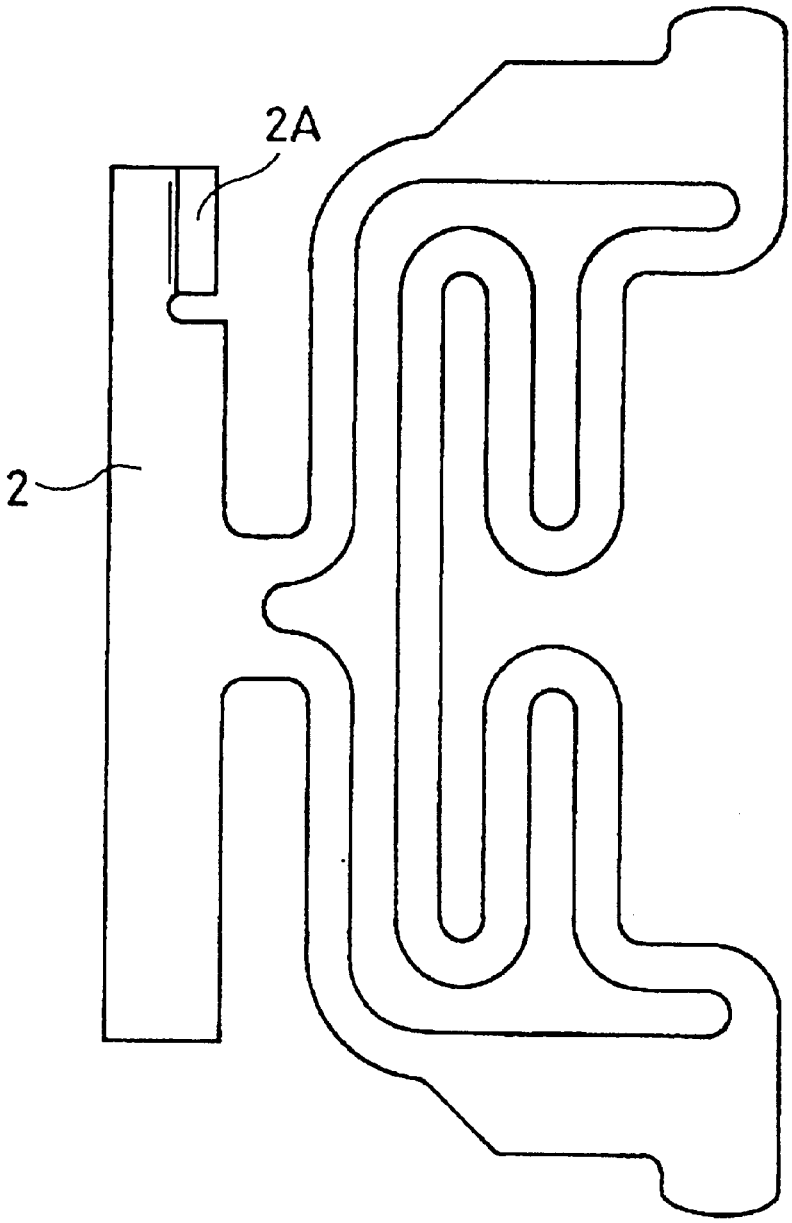
Figure 10:
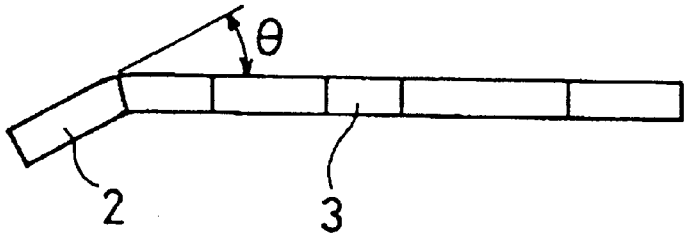
FIGS. 10A and 10B are top and front views of another variation of the contact element of FIG. 8.
Figure 10:
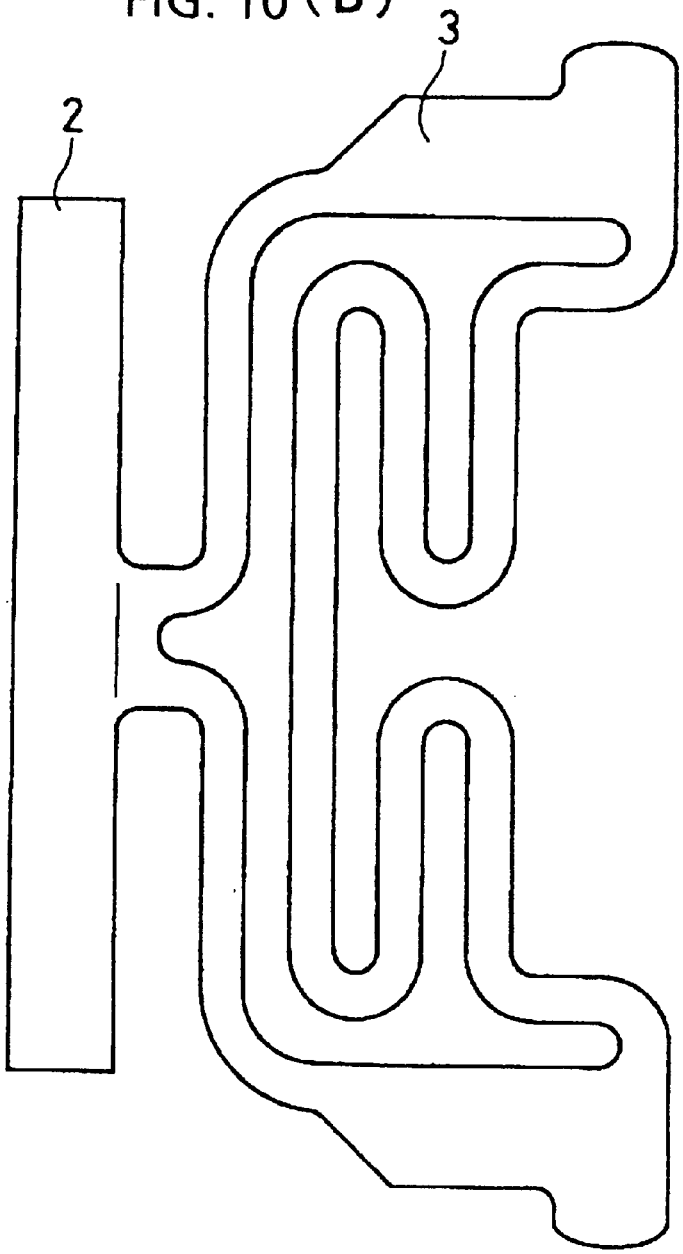

In FIGS. 9A and 9B, an engaging portion 2A similar to the one in FIG. 3 is provided on the fixing section 2 of the contact element of FIG. 8. In FIG. 10, the flexible section 3 is linked to the fixing section 2 with an angle θ as in FIG. 6.

Figure 11:
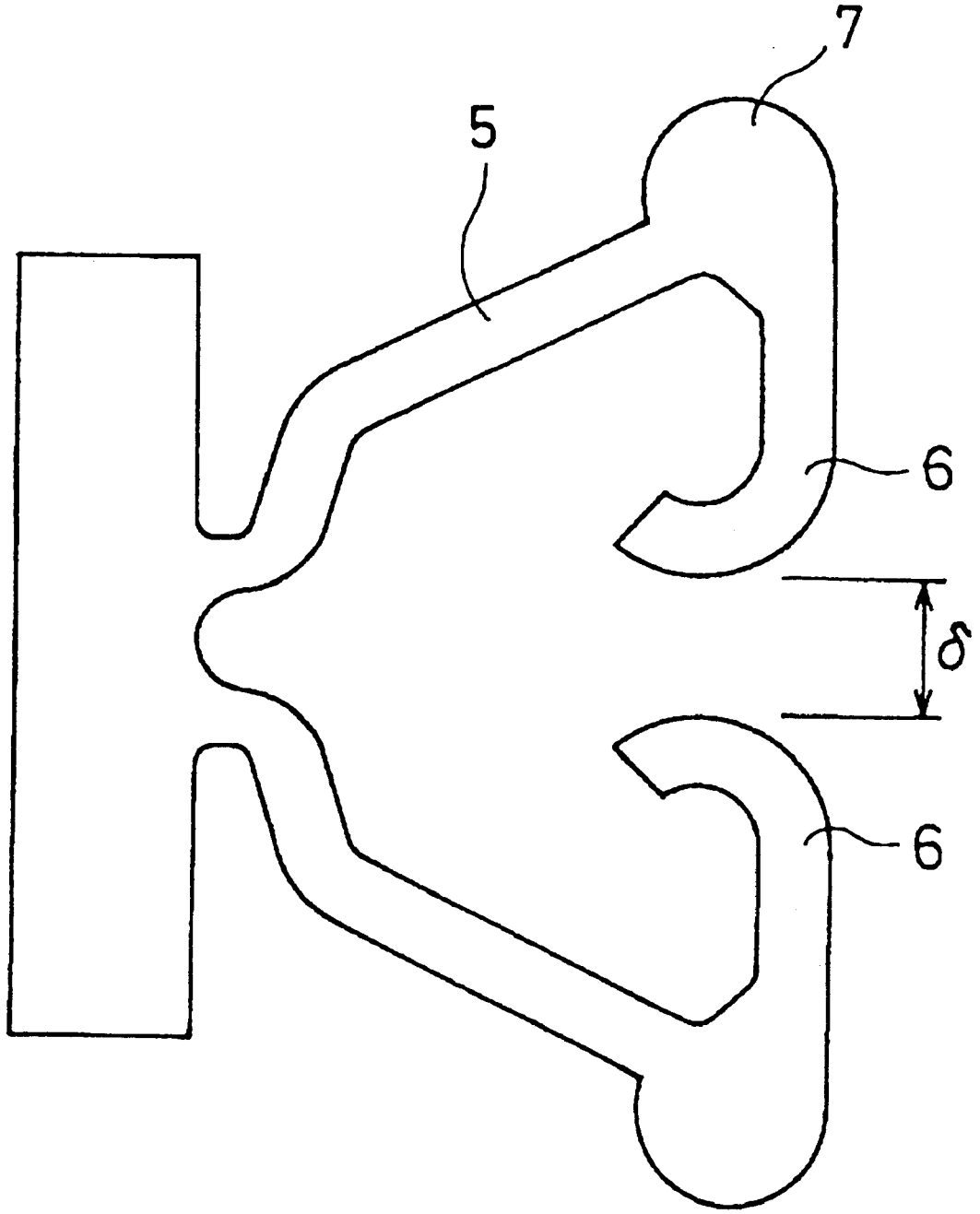
FIG. 11 is a front view of a contact element according to another embodiment of the invention.
Figure 12:
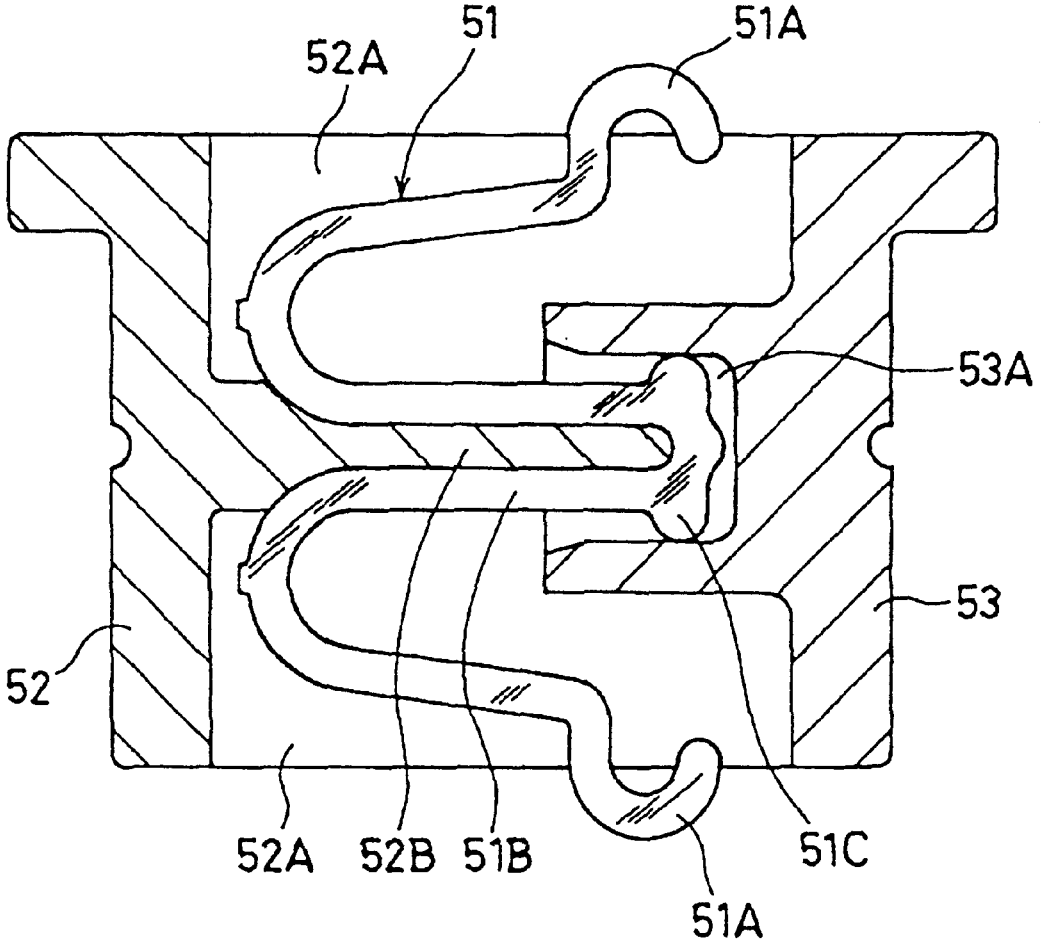
FIG. 12 PRIOR ART
FIG. 12 is a sectional view of a conventional interconnecting electrical connector.

In FIG. 11, the upper and lower second thin springs 6 are not linked together but spaced with a distance δ. The distance δ is set to be smaller than the sum of vertical movements of the contact points 7 so that when pressed by the connection members of mating connectors, the second thin springs 6 abut against each other as the contact points 7 move to a predetermined distance, increasing the recovery force of the first thin springs 5. In this embodiment it is possible to make the transmission line shorter than ever before.

As has been described above, the contact elements of the interconnecting electrical connector has fixing and flexible sections stamped from a metal sheet. The flexible sections have a pair of upper and lower first thin springs extending laterally from the fixing section and a pair of second thin springs extending from the first thin springs, with the ends linked or spaced. The contact points are provided at joints between the first and second thin springs so that they move both vertically and horizontally within the slots when making contact with the connection members of mating connectors, providing the wiping effects and cleaning the contact surfaces. Since the second thin springs reinforce the first thin springs, the miniaturized contact elements are sufficiently strong for making miniaturized connectors.

The transmission line between the upper and lower contact points made up of shorter thin springs is shorter than the conventional one, providing improved electrical characteristics. More specifically, the transmission line is made up of two paths; i.e., the first and second thin springs so that high frequency signals flow in the shorter transmission line for improved characteristics while low frequency signals flow in both of the transmission lines in large amount. That is, the shorter transmission line meets a requirement of accurate reproduction of waveforms for high frequency transmission while the double transmission line meets a high current capacity of d.c. or low frequency transmission because of the higher conductance of two transmission lines. In addition, the contact elements are made by stamping or discharge cutting and small bending operations so that the manufacturing and assembling is made easy at low cost.

What is claimed is:

1. An interconnecting electrical connector comprising:

an insulation housing having at least one slot extending in a direction of thickness of said insulation housing;

at least one contact element made by stamping from a metal sheet and inserted in said slot, said contact element comprising:

a rigid fixing section inserted along a side of said slot;

a flexible section extending from said rigid fixing section toward another side of slot; said flexible section comprising:

a pair of upper and lower first thin springs extending outwardly from said fixing section toward upper and lower openings of said slot, respectively, and toward said another side of said slot;

a pair of second thin springs extending inwardly from said first thin springs to form a loop at least when two mating connectors are brought into contact with said contact element and a pair of contact points provided at joints between said first and second thin springs.

2. An interconnecting electrical connector according to claim 1, wherein said fixing section comprises an engaging portion and said slot comprises a stepped portion for engagement with said engaging portion.

3. An interconnecting electrical connector according to claim 1, wherein said contact element comprises a linking section for linking said flexible section to said fixing section such that said flexible and fixing sections are in two parallel planes and said slots are provided in a point symmetrical fashion and comprise flexible section receiving sections facing each other.

4. An interconnecting electrical connector according to claim 2, wherein said contact element comprises a linking section for linking said flexible section to said fixing section such that said flexible and fixing sections are in two parallel planes and said slots are provided in a point symmetrical fashion and comprise flexible section receiving sections facing each other.

5. An interconnecting electrical connector according to claim 1, wherein said contact element comprises a linking section for linking said fixing and flexible sections at an angle and said slots have fixing section receiving sections arranged in a line.

6. An interconnecting electrical connector according to claim 2, wherein said contact element comprises a linking section for linking said fixing and flexible sections at an angle and said slots have fixing section receiving sections arranged in a line.

7. An interconnecting electrical connector according to claim 1, wherein said second thin springs are linked to each other to form a loop.

8. An interconnecting electrical connector according to claim 1, wherein said second thin springs are opposed to each other on said another side of said slot.

* * * * *